United States Patent [19]

Holzgruber et al.

[11] 4,039,022

[45] Aug. 2, 1977

[54] PROCESS FOR PRODUCING ELONGATED INGOTS OF STEEL

[75] Inventors: Wolfgang Holzgruber; Adolf Schneidhofer, both of Kapfenberg, Austria

[73] Assignee: Vereinigte Edelstahlwerke AG, Vienna, Austria

[21] Appl. No.: 654,057

[22] Filed: Jan. 30, 1976

Related U.S. Application Data

[63] Continuation-in-part of Ser. No. 250,972, May 8, 1972, abandoned.

[30] Foreign Application Priority Data

May 19, 1971 Germany ..... 2124960

[51] Int. Cl.[2] ..... B22D 7/00

[52] U.S. Cl. ..... 164/52

[58] Field of Search ..... 164/52, 252

[56] References Cited

U.S. PATENT DOCUMENTS

| | | | |
|---|---|---|---|
| 3,067,473 | 12/1962 | Hopkins | 164/52 |
| 3,546,349 | 12/1970 | Swoboda | 13/34 |
| 3,587,715 | 6/1971 | Holzgruber et al. | 164/252 |

FOREIGN PATENT DOCUMENTS

| | | | |
|---|---|---|---|
| 1,347,210 | 2/1974 | United Kingdom | 164/52 |

*Primary Examiner*—Ronald J. Shore

[57] ABSTRACT

To produce elongated ingots consisting of steel in an ingot mold, a plurality of electrodes are fused down in succession in a slag bath maintained in said ingot mold and having a depth of at least 0.9 and at most 1.8 times the square root of the diameter of said ingot mold in centimeters, provided that the depth is at least 4 centimeters. Each succeeding electrode is replaced for the preceding one within 150 seconds.

5 Claims, 2 Drawing Figures

PROCESS FOR PRODUCING ELONGATED INGOTS OF STEEL

Figure 1:
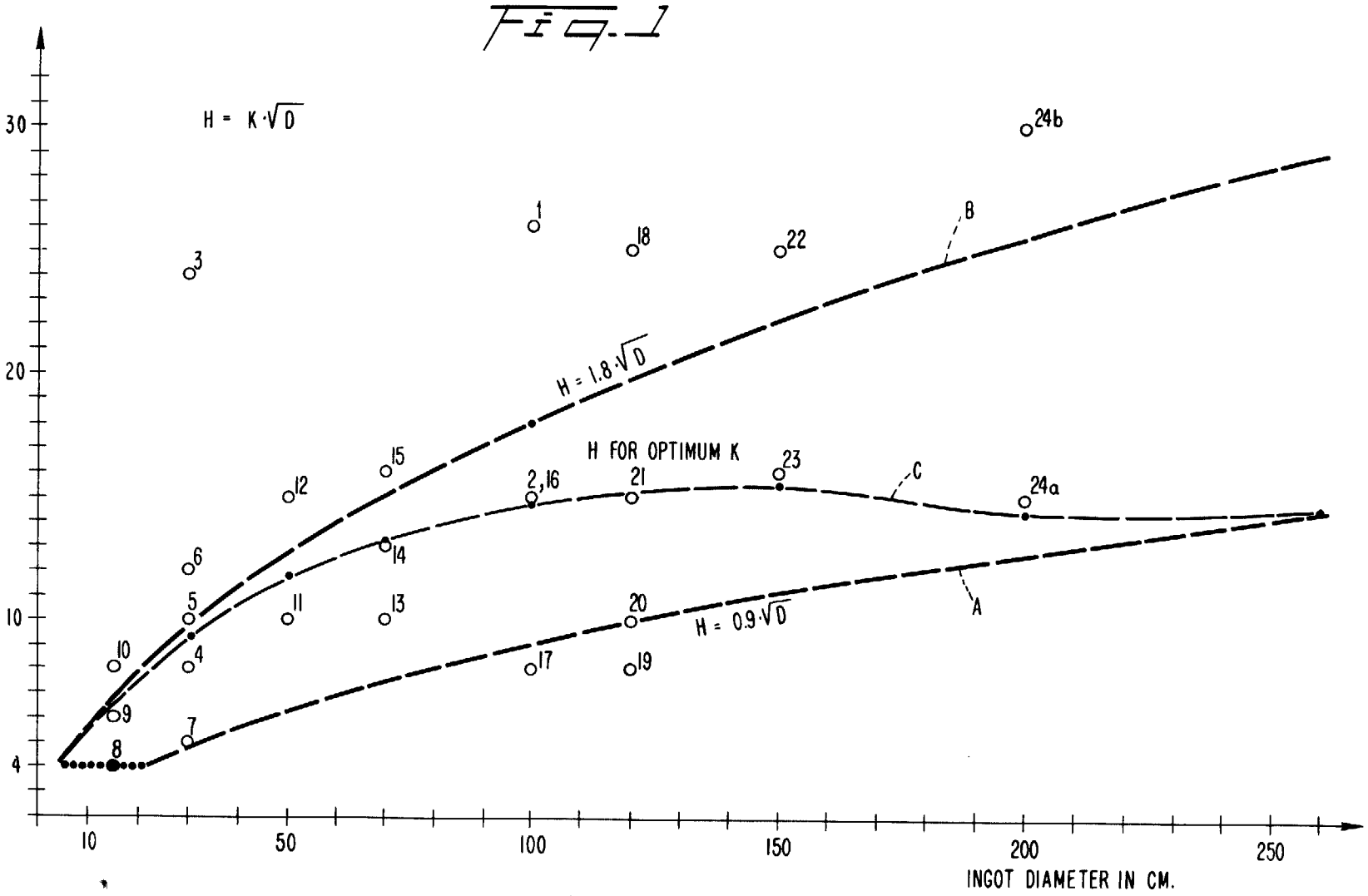

This application is a continuation-in-part of our copending application Ser. No. 250,972, filed May 8, 1972, and now abandoned.

The present invention relates to a process of producing elongated ingots of steels by the known electric slag remelting process.

In connection with the invention, an elongated ingot is an ingot which, if circular in cross section, has a length which is at least three times the diameter of the ingot. In ingots having other configurations in cross section, such as slab ingots or polygonal ingots, the computation is to be based on the diameters of circles equal in area.

The electric slag remelting process is recommendable whenever the product is to meet quality requirements which are higher than those which can be fulfilled with conventional methods.

A prerequisite or successfully meeting quality requirements is a largely continuous mode of operation, i.e., in view of the large quantities of steel to be remelted very long electrodes must be used, which necessitates great building heights of the plants. Since the material of the electrode melts at the tip thereof immersing into the slag bath, a certain distance between the end of the electrode and the metal sump in the cooled mold must be maintained, which distance is occupied by liquid slag. As the slag is to act like a purifying agent in respect of the metal droplets melting off, it is necessary to provide for a sufficient time of contact of these droplets with the liquid slag. This is to say that for the effect of purification the slag bath should be as deep as possible. On the other hand, heat energy has to be employed for heating up the slag bath, the major part of which is absorbed via the mold cooling. From this point of view the depth of the slag bath should be as low as possible.

In order to avoid great construction heights of electric slag remelting plants, it was tried to melt off a plurality of relatively short electrodes successively. The exchange of electrodes, necessitated by such mode of operation, had to be effected in a time as short as possible, which, from the point of view of construction, involved only minor difficulties. However, what was problematic was the cooling of the mold which had, of necessity, to be continued during the electrode exchange and which had the negative consequence of a cooling off of the slag bath. Therefore, during the electrode exchange, non-consumable auxiliary electrodes were employed, which helped to maintain the supply of current and thus the slag temperature.

Nevertheless, a number of difficulties occurred when carrying out this type of remelting process, which difficulties impaired the result of the process and, in extreme cases, led to non-usable ingots. The difficulties mentioned include the desired achievement of a sufficient degree of purity, i.e., the absence, as far as possible, of undesired accompanying elements, the achievement of an optimum primary crystallization and, finally, the danger of the occurrence of segregation lines in those zones of the ingot that were formed during the electrode exchange.

It is an object of the invention to provide a process with which the above difficulties can be overcome. The process according to the invention is based on the observation that the depth of the slag bath is highly significant and that there is a relation between this depth and the diameter of the ingot mold in the technologically interesting range and that this range can be sufficiently exactly stated for practical purposes. This range can be stated for ingot diameters between about 10 and 250 centimeters.

Basically, it must be pointed out that the quality of the product is improved as the depth of the slag bath is increased. By experience, the action of the slag to remove undesired accompanying elements from the metal increases with the depth of the slag bath. This is probably due to the fact that the purification of the drop of molten metal supplied from the tip of the electrode increases with the time in which the drop moves through the slag bath. As the residence time of the drop in the slag bath increases, the purifying metallurgical reactions are more and more completely performed.

Besides, the use of deeper slag baths results in a sump having a flatter configuration. When considered in vertical sections on imaginary planes through the ingot axis, the configuration of the sump may be compared to a segment of a circle, the chord being defined by the interface between the slag and the metal bath and the arc of a circle being defined by the interface between the liquid and solid metallic phases. Hence, the radius of the arc of this imaginary segment of a circle increases and the curvature of the sump decreases with an increase in the depth of the slag. This result is quite desirable because it results in a primary crystallization which is relatively uniform throughout the cross section, as is metallurgically desirable.

It will be understood that the depth of the slag bath cannot be increased as much as may be desired. Surprisingly, an unlimited increase is not necessary for optimum conditions, and an increase of the depth of the slag bath beyond an upper limit may even have detrimental results, particularly if the ingot is made from a plurality of electrodes fused down in succession rather than from a single electrode.

With the process of the present invention it is possible to produce metallurgically completely satisfactory elongated ingots in an electric slag remelting process with a plurality of electrodes fused down successively. After numerous experiments it has been found that a simple mathematical relationship determines the permissible depth of the slag bath, which depth is at the same time sufficient for a satisfactory purification, and the ingot mold diameter ranging between about 10 centimeters and about 250 centimeters, namely the relationship $$H = K\sqrt{D} \text{ (centimeters).}$$

In this equation, $H$ stands for the depth of the slag bath in centimeters to be used, with which depth unfavorable effects on the structure of the ingot in spite of an exchange of electrodes are avoided, $D$ stands for the diameter of the ingot mold in centimeters and $K$ represents a factor lying between 0.9 and 1.8.

With larger mold diameters of about 250 centimeters the optimum value of $K$ lies near the lower limit of the above stated range, i.e., near 0.9, and with smaller mold diameters of about 10 centimeters the optimum value of $K$ lies near the upper limit of the stated range, i.e., near 1.8.

The invention, thus, provides a process of producing elongated ingots of steel in a cooled mold which consists in that a plurality of electrodes is fused down successively in a slag bath contained in the cooled mold which slag bath has a depth of at least 0.9 times the square root of the diameter of the ingot mold in centimeters and at most 1.8 times the square root of the diameter of the ingot mold in centimeters, provided that said depth is not lower than 4 centimeters, the diameter of said ingot mold ranging between 10 and 250 centimeters, wherein each succeeding electrode is replaced for the preceding one within 150 seconds.

Preferably, the value of the factor $K$ in the formula $$H = K\sqrt{D} \text{ (centimeters)}$$

of 0.9 is allocated to the larger mold diameter of 250 centimeters and the value of the factor $K$ of 1.8 to the smaller mold diameter of 10 centimeters.

The operational safety of the process of the present invention is enhanced if the tip of the exchangeable electrode to be immersed into the slag bath is, prior to being immersed, preheated to a temperature of between 300° and 900° C. A preheating temperature of between about 500° and 700° C is preferred.

In the accompanying drawings, the limits of the depth of the slag bath to be employed in accordance with the present invention are graphically illustrated. Herein, FIG. 1 shows the ingot diameters in centimeters on the abscissa and the depths of the slag bath in centimeters on the ordinate as these depths result from the equation $$H = K\sqrt{D}.$$

The lower line A, having a flatter configuration, corresponds to the minimum values of the depths of the slag bath to be employed in accordance with the factor $K = 0.9$, and the upper line B, having a somewhat steeper course, corresponds to the maximum values of the slag bath depths to be employed in accordance with the value of the factor $K = 1.8$, relative to the mold diameter of from about 10 to 250 centimeters to be employed.

Figure 2:
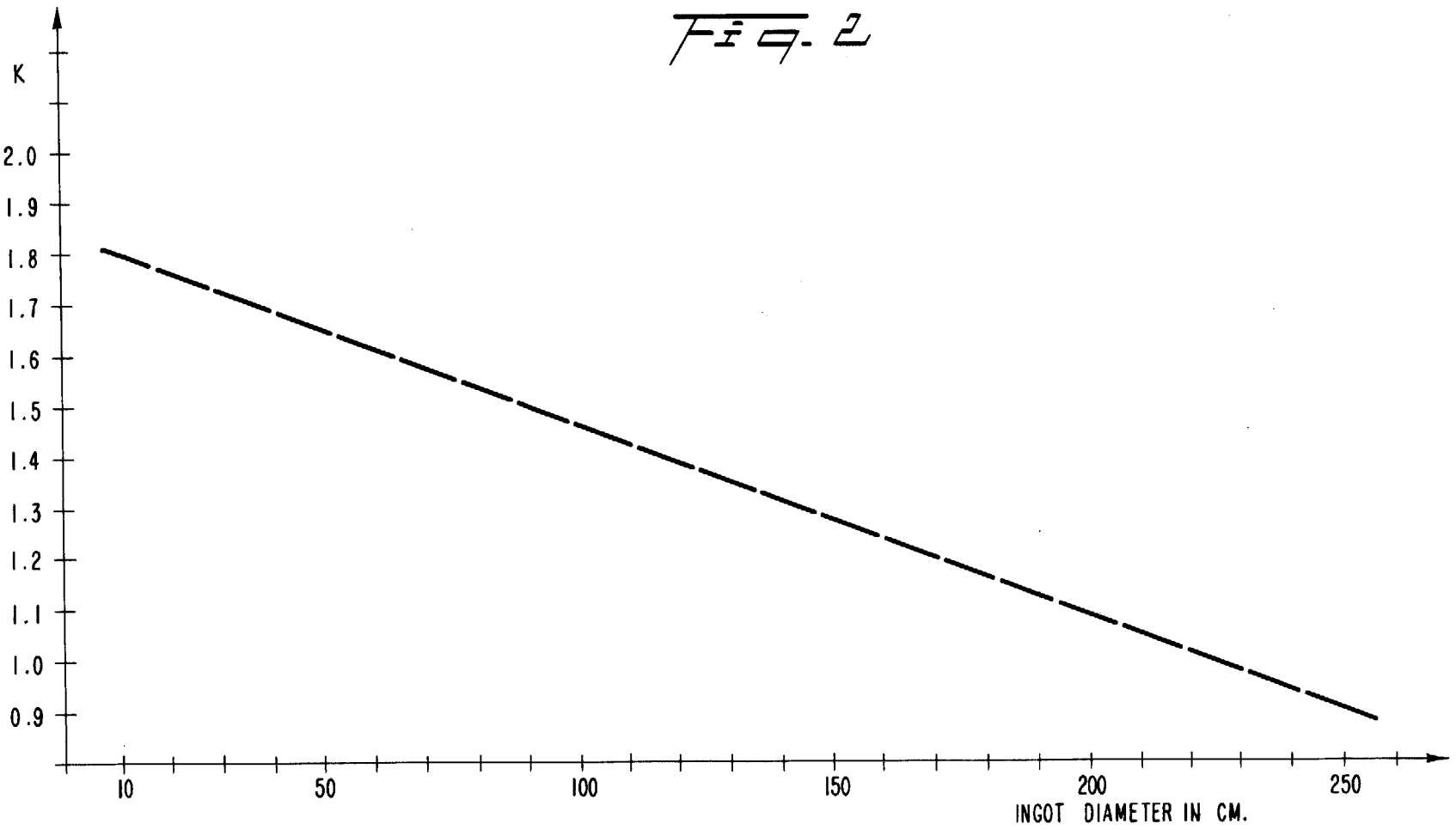

FIG. 2 shows the optimum values for the factor $K$ in dependence upon the mold diameter of from 10 to 250 centimeters on a straight line. If these optimum $K$ values are entered in the diagram of FIG. 1 a curve C results that divides the field between the upper line B and the lower line A, which curve C indicates the optimum slag bath depths relative to the respective mold diameters.

The following examples illustrate in more detail the process of the present invention without limiting the application thereto. The slag bath depths employed in these examples are shown in FIG. 1 and indicated with the numbers of the respective examples.

EXAMPLE 1

Square forgings of 500 mm widths of a H 13 steel (X 40 CrMoV 5 1) of highest quality were to be produced. During melting of the steel in the electric arc furnace difficulties occurred with the refractory lining, so that the refining period had to be shortened. Consequently, the cast electrodes having diameters of 60 centimeters and lengths of 2.7 meters had sulphur-contents of 0.038% and oxygen-contents of 185 ppm; it was hoped that with the electric slag remelting process, when employing greater slag bath depths, a more favorable purification would be achieved. The three electrodes cast were successively remelted in an electric slag remelting process to form an ingot having a diameter of 100 centimeters while a slag bath depth of 26 centimeters — as it was in accordance with the prior art — was employed. The electrode exchange took 80 seconds each. The ingot obtained had a weight of 18 metric tons and was 3 meters long. It was hot shaped on a forging press to obtain a 500 mm square piece, which was then examined as to its quality. The examination showed that the sulphur-content had decreased to 0.009% and the oxygen-content to 28 ppm, which was in accordance with the requirements. Ultrasonic testing, however, revealed faults in some areas, which meant that the steel was not suited for the specific field of application it had been intended for. A closer examination exhibited segregation lines and material parting lines, due to the forging procedure, over a length of almost 2 meters, which was due to the preceding four-fold degree of shaping.

EXAMPLE 2

To replace the material obtained in example 1 a further charge had to be melted and cast into equal electrodes. This steel was remarkably purer (0.013% S, 40 ppm O), so that, for the purpose of saving energy, it was possible to use a slag bath depth of 15 centimeters for the remelting process. From the ingot obtained, having a diameter of 100 centimeters and a length of 3 meters, a 500 mm square piece was forged. Ultrasonic testing revealed no faulty spots, also the quality met the requirements. Pickled disks showed no segregation zones or rings even in those ingot areas which had been formed during the electrode exchange.

EXAMPLE 3

Thereupon, comprehensive experiments were made in order to investigate the apparent influence of the depth of the slag bath onto the quality of the remelted material. For this purpose, two test ingots of 30 centimeters diameter of the same steel as above were remelted, using a slag bath depth of 24 centimeters each from two electrodes of different diameters, namely 10, 15, 18 and 22 centimeters, with changes in voltage, strength of current and electric output and with melting off rates of 146, 182, 253, 309 and 382 kg/h, and a further ingot from five electrodes with a diameter of 16.5 centimeters and a length of 2 meters with electrode exchange periods of 80, 60, 40 and 22 seconds. From all the test ingots longitudinal cuts were made and deep etched. The visible segregation lines, resulting from the electrode renewals, had only been insignificantly influenced by the changes in process parameters. The degree of segregation of molybdenum, which amounted to 2.70 in zones of normal ingot formation, reached the unusual and unfavorable value of 4.40 in the segregation zones. Thus, it was not possible to obtain a segregation-free ingot with a slag bath depth of 24 centimeters.

EXAMPLE 4

Thereupon, a 30 centimeter diameter ingot of the same steel was remelted from four electrodes of diameters of 18 centimeters and lengths of 2 meters fused down successively, while providing for electrode exchanges each within 60 seconds, a melting off rate of 235 kg/h and a slag bath depth of only 8 centimeters. The ingot obtained showed a perfect structure without segregation lines.

EXAMPLE 5

A repetition of the test according to example 4 with a slag bath depth of 10 centimeters and four 18 centimeter electrodes while interrupting the supply of current for periods of 40, 65 and 80 seconds during the electrode exchanges also resulted in an ingot free from segregation lines.

EXAMPLE 6

A further test of the same kind was carried out with the three electrode exchanges of the 18 centimeter electrode and with a slag bath depth of 12 centimeters; the hot etched cuts taken out clearly showed segregations whose intensity was almost independent of the electrode exchange times of lengths of 30, 45 and 70 seconds, respectively.

EXAMPLE 7

A further repetition of the test with a slag bath of only 5 centimeters resulted in local slag overheating, minor reductions in slag bath depth caused the formation of electric arcs and thus ingot sump movements with the unfavorable consequence of segregations.

EXAMPLE 8

In order to further examine the effects of low slag bath depths, test ingots of diameters of 15 centimeters were remelted from electrodes of 9 centimeter diameters. Only with a slag bath depth of 4 centimeters a smooth flow of the process was possible, below that depth electric arc phenomena occurred at the transit of a droplet from the electrode to the molten ingot and no optimum distribution of heat was achieved. The portions of the ingot that had been produced with a slag bath depth of 4 centimeters and above were free from segregation lines. Also, the electrode changes with power-off times of 22, 60 and 120 seconds had not produced any segregation lines.

EXAMPLE 9

In this test a 15 centimeter ingot was remelted from 9 centimeter electrodes having lengths of 1.5 meters using a slag bath depth of 6 centimeters for the electrode changes the supply of power to the slag pool was interrupted for 22, 60 and 120 seconds; the ingot produced showed no segregation lines.

EXAMPLE 10

From five electrodes of a diameter of 9 centimeters a further ingot having a diameter of 15 centimeters was produced using a slag bath depth of 8 centimeters. The longitudinal etched cuts of the ingot clearly showed segregation lines where the power supply to the slag bath had been interrupted for 22, 60 and 120 seconds during the electrode renewals.

EXAMPLE 11

An ingot having a diameter of 50 centimeters was remelted from four electrodes of 30 centimeter diameters with a slag bath depth of 10 centimeters. The electrode changes, during which no current was flowing through the slag pool and, therefore, the heat input was interrupted, were made within 45, 60, 100 and 140 seconds. A pickled cut taken out centrally in the longitudinal direction of the ingot showed no segregation lines whatsoever.

EXAMPLE 12

The same test was carried out with a slag bath depth of 15 centimeters and resulted in an ingot with clear segregations at those places where the electrode renewals had taken place.

EXAMPLE 13

In this and the two following test ingots of diameters of 70 centimeters were remelted from electrodes having 40 centimeters in diameter. At first, five electrodes were remelted while using a slag bath depth of 10 centimeters and four times interrupting the power supply for 62 seconds each. The ingot obtained had a perfect structure.

EXAMPLE 14

The repetition of the test with five electrodes of the type described in example 13, yet with a slag bath depth of 13 centimeters resulted in optimum values both from the point of view of remelting technology and from the point of view of heat distribution in the slag bath.

EXAMPLE 15

A further repetition of the test with four electrodes of 40 centimeter diameters and a slag bath depth of 16 centimeters led to an ingot with noticeable segregation lines in those zones where the supply of electrical energy had been interrupted.

EXAMPLE 16

In this test as well as in the following one ingot of 100 centimeter diameters were remelted from electrodes having diameters of 60 centimeters. At first, an ingot of a weight of 13.1 metric tons was remelted from three electrodes using a slag bath depth of 15 centimeters; optimum process conditions were observed, the longitudinal pickled cut showed no segregations resulting from the electrode exchange. Also the interruption of the supply of electric energy to the slag bath for 60 and 140 seconds because of the electrode change had not produced any segregation lines.

EXAMPLE 17

The repetition of this test with two electrodes each having a diameter of 60 centimeters and a weight of 4.5 tons with a slag bath depth of 8 centimeters resulted in a rough flow of the process with arcings from the electrode to the ingot. Longitudinal disks made from this ingot and etched showed not only an affected crystallization due to the electric arc disturbances but also segregation lines due to the electrode exchange; the purity of the material was comparatively worse.

EXAMPLE 18

This test served the purpose of examining whether the regularity found was also applicable in the case of larger ingot diameters. Herein, three electrodes of 70 centimeter diameters were successively remelted in a 120 centimeter diameter mold with a slag bath depth of 25 centimeters; during the exchange of electrodes an interruption of the power supply of 65 seconds in each case took place. The pickled disks taken from the ingot clearly showed segregation lines.

EXAMPLES 19 to 21

The repetition of this test was made with a slag bath depth of 8 centimeters. Apart from a rough course of the process, problems in heat distribution in the slag occurred and consequently the surface quality of the ingot was impaired. After fusing down 4 metric tons of the first electrode the slag bath depth was increased to 10 centimeters by adding slag. This mode of operation enabled a perfect remelting and no segregation lines formed during the electrode exchange taking 80 seconds. A further addition of slag at a time when an ingot weight of 14 metric tons had been built up led to optimum remelting conditions with a slag bath depth of 15 centimeters. On the longitudinal disk worked out of the ingot no segregation lines were noticed from that zone onward where a 10 centimeter slag bath depth had been employed; the structure was found to be optimal in the zone where the remelting had been carried out with a slag bath depth of 15 centimeters.

EXAMPLE 22

This test was carried out with the same steel H 13 with 85 centimeter electrodes in a 150 centimeter diameter mold and under use of a 25 centimeter slag bath depth. The pickled disks taken out of the ingot clearly showed segregation lines in those zones where the power supply had been interrupted for 60, 100 and 140 seconds.

EXAMPLE 23

The repetition of this test with a slag bath depth of 16 centimeters resulted in an ingot which showed no structure faults whatsoever both in the area of the first electrode exchange taking 65 seconds and in the area of the second electrode exchange taking 100 seconds.

EXAMPLE 24

This test was carried out in a 200 centimeter diameter mold with electrodes of 100 centimeter diameters and with a slag bath depth of 15 centimeters, for each electrode exchange the power supply was discontinued for 148 seconds. The structure of the obtained ingot was free from faults.

EXAMPLE 24

When this test was repeated with a slag bath depth of 30 centimeters a segregation line was noticeable, even though the power supply had been interrupted for 40 seconds only.

What is claimed is:

1. A process of producing elongated ingots of steel in a cooled ingot mold having a diameter of between about 10 and about 250 centimeters, which comprises the steps of fusing down a plurality of electrodes in succession in a slag bath contained in said ingot mold and having a depth $H$, wherein said slag bath depth is adjusted according to the formula $$H = K\sqrt{D} \text{ (centimeters)},$$

$D$ standing for the diameter of the ingot mold in centimeters and $K$ representing a factor lying between 0.9 and 1.8, the factor of 0.9 being optimum with an ingot mold diameter of about 250 centimeters and the factor of 1.8 being optimum with an ingot mold diameter of about 10 centimeters, provided that said depth amounts to at least 4 centimeters, and replacing each succeeding electrode for the preceding electrode within 150 seconds.

2. A process as set forth in claim 1, in which the ingot mold is of circular cross section and in which the ingot produced has a length of at least three times its diameter.

3. A process as set forth in claim 1, in which the ingot mold is of polygonal cross section equal in area to a circle with a diameter $D$ in centimeters and in which the ingot produced has a length of at least three times the diameter $D$ of the circle equal in area.

4. A process as set forth in claim 1, in which each of said electrodes is immersed into said slag bath in a predetermined length portion and said length portion of each succeeding electrode is preheated to a temperature of between 300° and 900° C before it is immersed into said slag bath.

5. A process as set forth in claim 4, in which said length portion of each succeeding electrode is preheated to a temperature of between 500° and 700° C before it is immersed into said slag bath.

* * * * *